US008130114B2

(12) United States Patent
Yanagi et al.

(10) Patent No.: US 8,130,114 B2
(45) Date of Patent: Mar. 6, 2012

(54) ENTRY DETECTING SYSTEM

(75) Inventors: Masahiro Yanagi, Shinagawa (JP); Shigemi Kurashima, Shinagawa (JP); Takashi Yuba, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 1301 days.

(21) Appl. No.: 11/808,756

(22) Filed: Jun. 12, 2007

(65) Prior Publication Data

US 2008/0218367 A1 Sep. 11, 2008

(30) Foreign Application Priority Data

Mar. 6, 2007 (JP) ..... 2007-055819

(51) Int. Cl.
*G08B 21/00* (2006.01)

(52) U.S. Cl. ..... 340/686.1; 340/539.13; 340/568.5; 340/571; 340/5.91; 340/6.1

(58) Field of Classification Search ..... 340/539.13, 340/568.1, 568.5, 571, 5.91, 6.1
See application file for complete search history.

(56) References Cited

U.S. PATENT DOCUMENTS 5,764,145 A * 6/1998 Hansson et al. ..... 340/562
6,321,083 B1 * 11/2001 Vaara et al. ..... 455/446
6,788,199 B2 * 9/2004 Crabtree et al. ..... 340/539.13
7,075,432 B2 * 7/2006 Roberts et al. ..... 340/568.1
7,397,373 B2 * 7/2008 Hunt ..... 340/568.1
7,663,504 B2 * 2/2010 Votaw et al. ..... 340/902
2001/0028301 A1 * 10/2001 Geiger et al. ..... 340/5.91
2005/0258975 A1 11/2005 Hunt
2006/0247847 A1 * 11/2006 Carter et al. ..... 701/200
2007/0194944 A1 * 8/2007 Galera et al. ..... 340/686.6
2007/0200759 A1 * 8/2007 Heidari-Bateni et al. .... 342/387

FOREIGN PATENT DOCUMENTS

JP 2005-534093 11/2005

OTHER PUBLICATIONS

"Ask Dr. Math FAQ—Distance, Rate, and Time", The Math Forum @ Drexel, Drexel University, © 1994-2011; http://mathforum.org/dr.math/faq/faq.distance.html (Copy provided as Appendix A in attached Office action).*
International Publication No. WO 2004/010394 published Jan. 29, 2004.

* cited by examiner

*Primary Examiner* — Benjamin C Lee
*Assistant Examiner* — Peter Mehravari
(74) *Attorney, Agent, or Firm* — Staas & Halsey LLP

(57) ABSTRACT

An entry detecting system includes a terminal device; a point-to-point communication device; an entry detecting device; and a guard device. The point-to-point communication device includes a transmitting-receiving antenna having directivity in a specific direction. The point-to-point communication device communicates by radio with the terminal device via the transmitting receiving antenna so as to detect a response time from the terminal device and report detected response time to the entry detecting device. The entry detecting device detects a distance from the point-to-point communication device to the terminal device based on the response time reported by the point-to-point communication device, generates entry detecting information based on the detected distance, and transmits the entry detecting information to the point-to-point communication device and the guard device. The point-to-point communication device transmits the received entry detecting information to the terminal device.

4 Claims, 12 Drawing Sheets

ENTRY DETECTING SYSTEM

BACKGROUND OF THE INVENTION

1. Field of the Invention

The present invention generally relates to entry detecting systems, and more specifically, to an entry detecting system whereby entry to an entry prohibited area by a shopper in a shopping center or the like is detected.

2. Description of the Related Art

Recently, an internal structure of a large scale shop such as a shopping center has become complex so that a shopper may enter an entry prohibited area in error. On the other hand, for the recent large scale shopping center, a system where a terminal device is provided at a cart and information of merchandise and others are displayed so that shopper's interest is improved has been suggested.

Because of this, by using the terminal device provided at the car, the entry prohibited area is reported to the shopper or notification of the shopper entering the entry prohibited area is made to a guard, so that it is possible to prevent the shopper from entering the entry prohibited area.

For example, Japanese Laid-Open Patent Application Publication No. 2005-534093 describes a system for preventing the entry into the entry prohibited area in a shop, the system having a radio receiver provided at a cart; a radio transmitter is provided in the entry prohibited area in the shop; and the cart issues a warning when the cart entries the entry prohibited area.

In the related art system whereby entry to the entry prohibited area in the shop is prevented, the radio receiver is provided at the cart and the cart issues a warning in response to a signal from the radio transmitter provided in the entry prohibited area.

Therefore, in this system, after the cart enters the entry prohibited area, the alarm is issued. Hence, response by the guard to the like may be delayed.

SUMMARY OF THE INVENTION

Accordingly, embodiments of the present invention may provide a novel and useful entry detecting system solving one or more of the problems discussed above.

More specifically, the embodiments of the present invention may provide an entry detecting system whereby entry to an entry prohibited area is reported by using a communication system having directivity in a specific direction.

One aspect of the present invention may be to provide an entry detecting system, including:

a terminal device;

a point-to-point communication device;

an entry detecting device; and a guard device;

wherein the point-to-point communication device includes a transmitting-receiving antenna having directivity in a specific direction;

the point-to-point communication device communicates by radio with the terminal device via the transmitting-receiving antenna so as to detect a response time from the terminal device and report detected response time to the entry detecting device;

the entry detecting device detects a distance from the point-to-point communication device to the terminal device based on the response time reported by the point-to-point communication device, generates entry detecting information based on the detected distance, and transmits the entry detecting information to the point-to-point communication device and the guard device;

the point-to-point communication device transmits the received entry detecting information to the terminal device;

the terminal device outputs an alarm in a case where the terminal device receives the entry detecting information from the point-to-point communication device; and the guard device outputs an alarm in a case where the guard device receives the entry detecting information from the entry detecting device.

Another aspect of the present invention may be to provide an entry detecting system, including:

a terminal device;

a point-to-point communication device; and a guard device;

wherein the point-to-point communication device includes a transmitting-receiving antenna having directivity in a specific direction;

the point-to-point communication device communicates by radio with the terminal device so as to detect a response time from the terminal device and measure distance to the terminal device based on the detected response time;

the point-to-point communication device reports the entry detecting information corresponding to the measured distance to the terminal device and the guard device; and the terminal device and the guard device output alarms when receiving the entry detecting information from the point-to-point communication device.

Other objects, features, and advantages of the present invention will be come more apparent from the following detailed description when read in conjunction with the accompanying drawings.

DETAILED DESCRIPTION OF THE PREFERRED EMBODIMENTS

A description is given below, with reference to the FIG. 1 through FIG. 12 of embodiments of the present invention.

[First Embodiment of the Present Invention]

Figure 1:
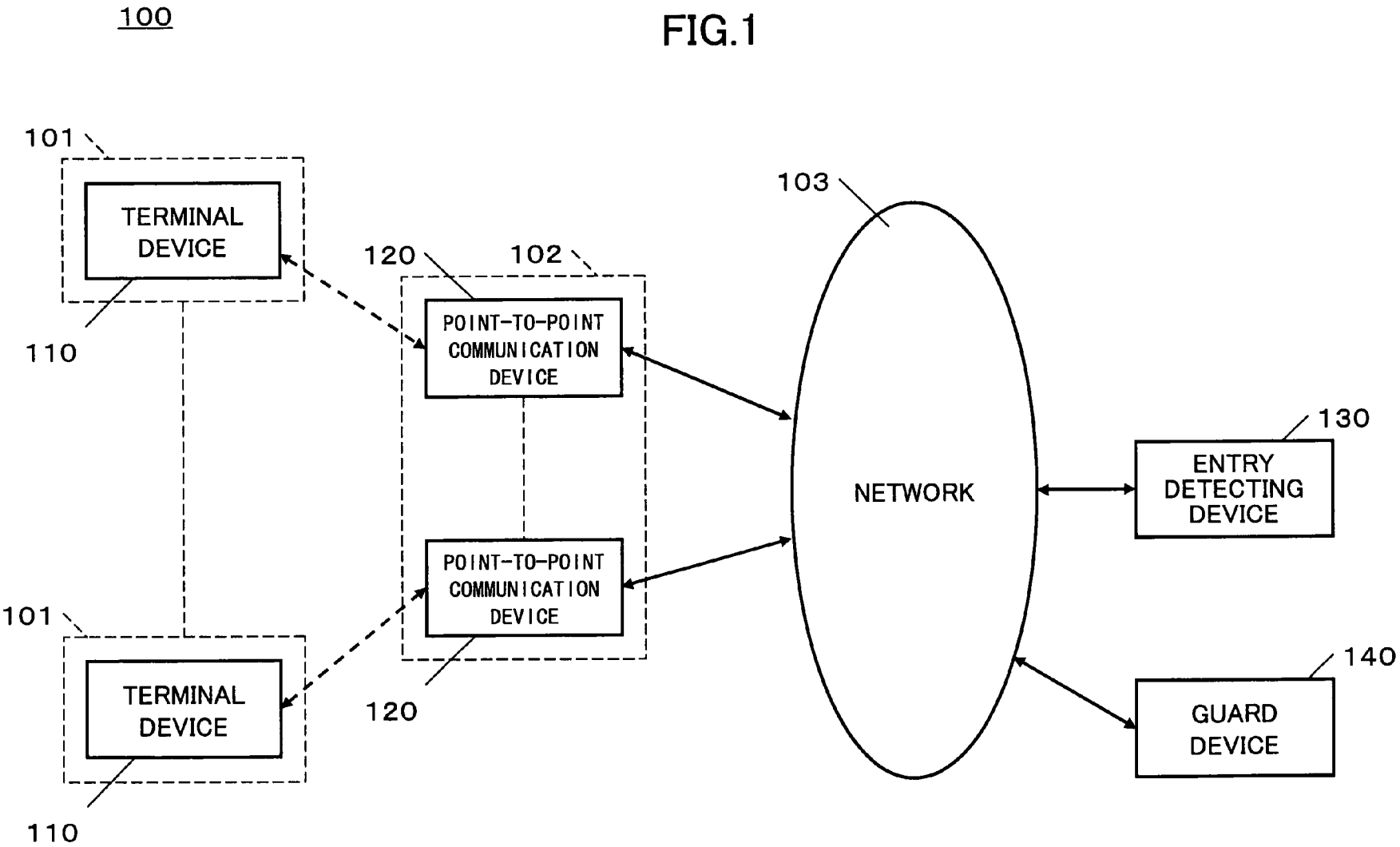
FIG. 1 is a schematic view of a system of a first embodiment of the present invention.

FIG. 1 is a schematic view of a system of a first embodiment of the present invention.

An entry detecting system 100 of the first embodiment of the present invention detects entry to an entry prohibited area by a shopper in a shopping center or the like. The entry detecting system 100 includes a terminal device 110, a point-to-point communication device 120, an entry detecting device 130, a guard device 140, and others.

UWB (Ultra-Wide-Band) communications can be performed between the terminal device 110 and the point-to-point communication device 120. In addition, communications can be performed via a network 103 such as a LAN between the point-to-point communication device 120 and the entry detecting device 130.

An antenna device having directivity in a specific direction is installed in the point-to-point communication device 120. The point-to-point communication device 120 is provided at an entrance of the entry prohibited area. The antenna device has, more specifically, directivity in a direction where the shopper may enter.

The point-to-point communication device 120 requests the terminal device 110 to respond by using the antenna device. The terminal device 110 transmits the response based on the response request from the point-to-point communication device 120. The point-to-point communication device 120 measures the response time from the terminal device 110 so as to notify the entry detecting device 130.

The entry detecting device 130 detects a distance to the terminal device 110 based on the response time reported by the point-to-point communication device 120. The entry detecting device 130 transmits entry detecting information to the point-to-point communication device 120 when the detected distance is a first distance L1. When the detected distance is a second distance L2 that is shorter than the first distance L1 (L2<L1), the entry detecting information is sent to the guard device 140.

When the point-to-point communication device 120 receives the entry detecting information from the entry detecting device 130, the point-to-point communication device 120 notifies the terminal device 110. When the terminal device 110 receives the entry detecting information from the point-to-point communication device 120, it is notified that the shoppers going to the entry prohibited area.

Furthermore, the guard device 140 is provided in a guard room. When the alarm device 140 receives the entry detecting information from the entry detecting device 130, an alarm is output.

Here, a structure of the cart 101 is discussed.

Figure 2:
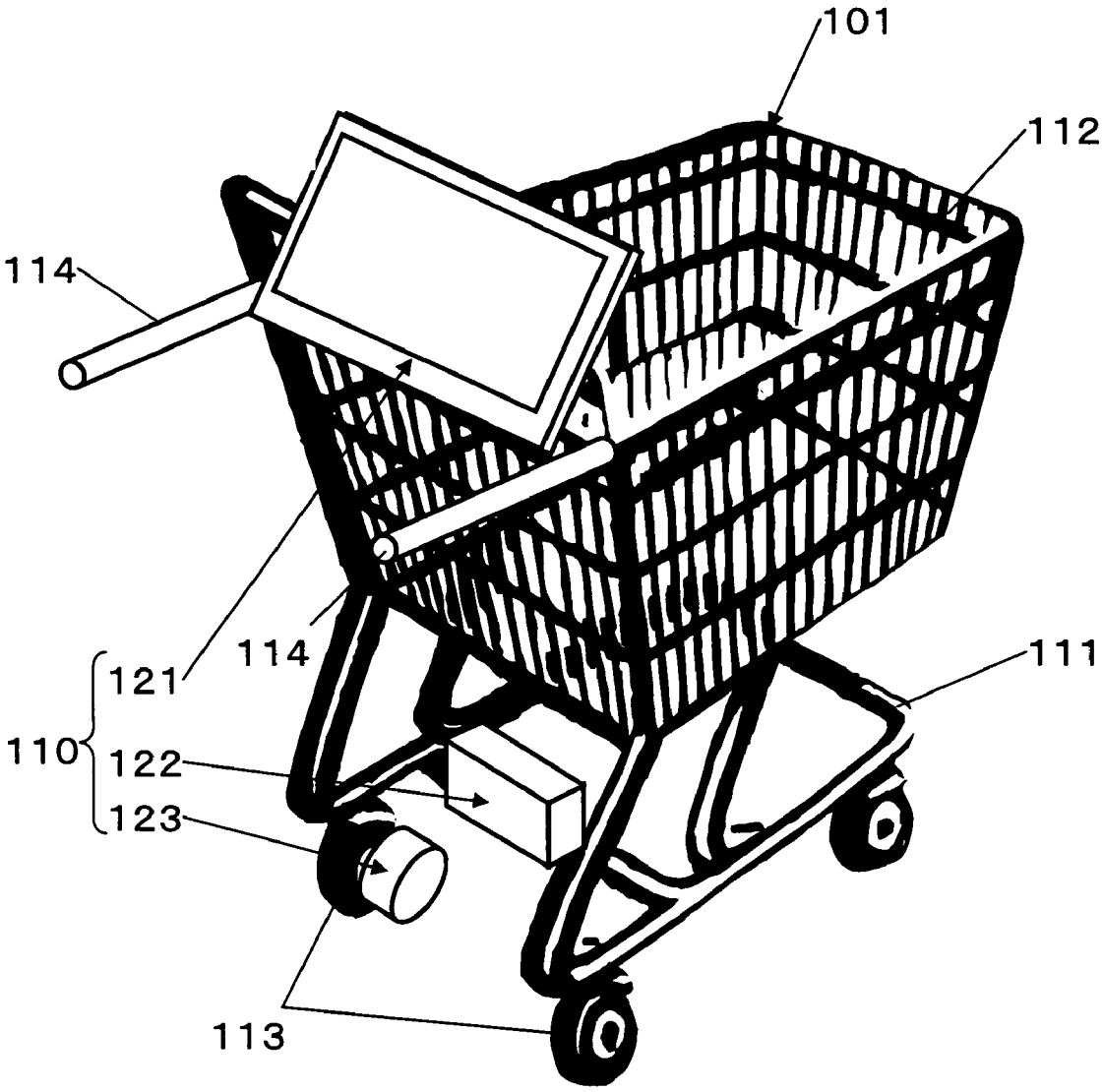
FIG. 2 is a perspective view of a cart 101.
Figure 3:
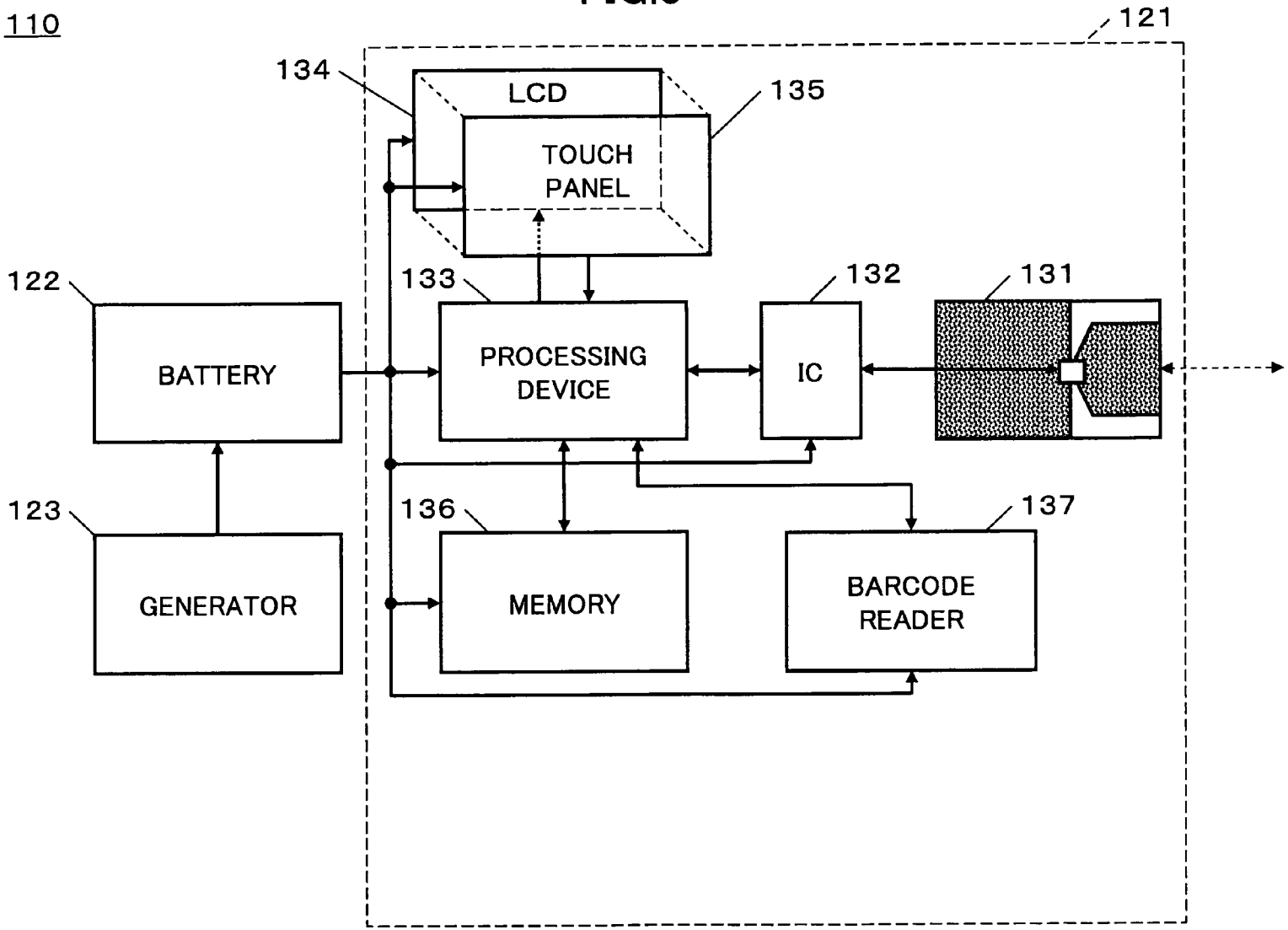
FIG. 3 is a block diagram of a terminal device 110.

FIG. 2 is a perspective view of the cart 101. FIG. 3 is a block diagram of the terminal device 110.

The terminal device 110 is provided at the cart 101 and moves together with the shopper.

The cart 101 includes a base stand 111, a basket 112, wheels 113, a handle 114, and others. The terminal device 110 is provided at the cart 101.

As shown in FIG. 2, the terminal device includes a device main body 121, a battery 122, and a generator 123. The terminal device 110 responds to response requests from the point-to-point communication device 120, receives information transmitted from the point-to-point communication device 120 based on a position and a moving path, and displays received information on a display.

As shown in FIG. 3, the device main body 121 includes a UWB antenna device 131, a UWB communication IC chip 132, a processing device 133, a display device 134, a touch panel 135, a memory 136, and others.

Figure 4:
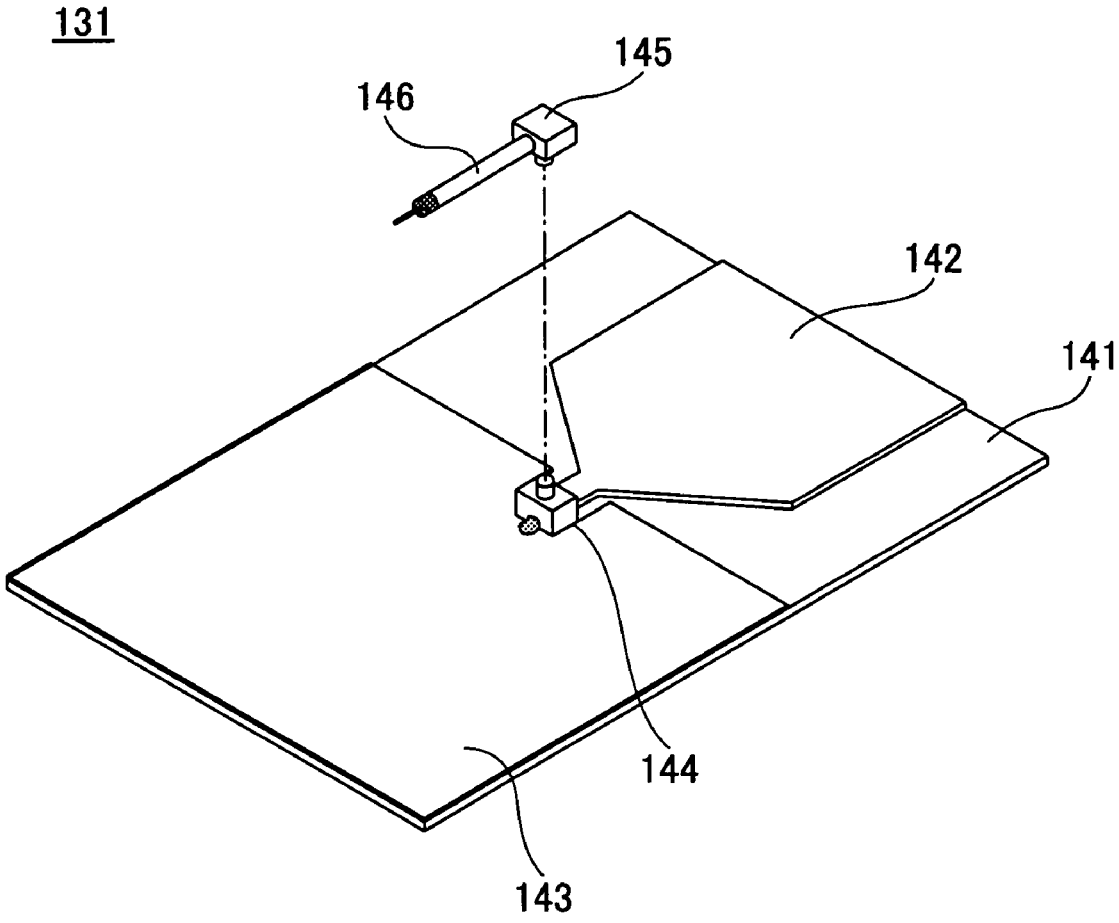
FIG. 4 is a perspective view of a UWB antenna device 131.

FIG. 4 is a perspective view of the UWB antenna device 131.

In the UWB antenna device 131, an element pattern 142 and a ground pattern 143 are formed on a flexible printed wiring board 141. A surface mounting socket connector 144 is soldered to the element pattern 142 and the ground pattern 143. The UWB antenna device 131 is adhered to a housing of the device main body 121.

A plug connecter 145 is connected to the surface mounting socket connector 144. One end of a coaxial cable 146 is connected to the plug connector 145. Another end of the coaxial cable 146 is connected to a UWB communication IC chip 132. The UWB antenna device 131 transmits and receives RF impulse.

Referring back to FIG. 3, the UWB communication IC chip 132 forms an impulse waveform based on a signal from the processing device 133 and executes a process for restoring an original signal from the impulse wave form received by the UWB antenna device 131.

The processing device 133 executes a process based on a terminal device control program.

The display device 134 is formed by, for example, a liquid crystal panel and is controlled by the processing device 133. The display device 134 displays an entry prohibition mark based on the entry detecting information provided by the entry detecting device 130 via the point-to-point communication device 120.

The touch panel 135 is provided on a front surface of the display screen of the display device 134 and operated by the shopper. The processing device 133 executes various processes based on the operation of the touch panel 135.

The memory 136 includes a RAM, a ROM, and others. The terminal device control program executed by the processing device 133 is installed in the memory 136. The memory is used as an operations storage area for a process by the processing device 133.

A barcode reader 137 may be provided at the terminal device 110. A barcode attached to or printed on merchandise is read and communicated to a POS system or the like via a network 103 so that a process for accounting or the like is implemented based on the read barcode. As a result of this, while shopping is done, an adjustment process can be implemented so that there is no need to implement an adjustment process at a register.

As shown in FIG. 2, the battery 122 is provided on the base stand 111 of the cart 101 so as to supply an electric power to the device main body 121.

A generator 123 generates electric power based on the rotation of the wheels 113 of the cart 101.

The electric power generated by the generator 123 is supplied to the battery 122. The battery 122 is charged by the electric power supplied from the generator 123.

Next, a structure of the point-to-point communication device 120 shown in FIG. 1 is discussed.

Figure 5:
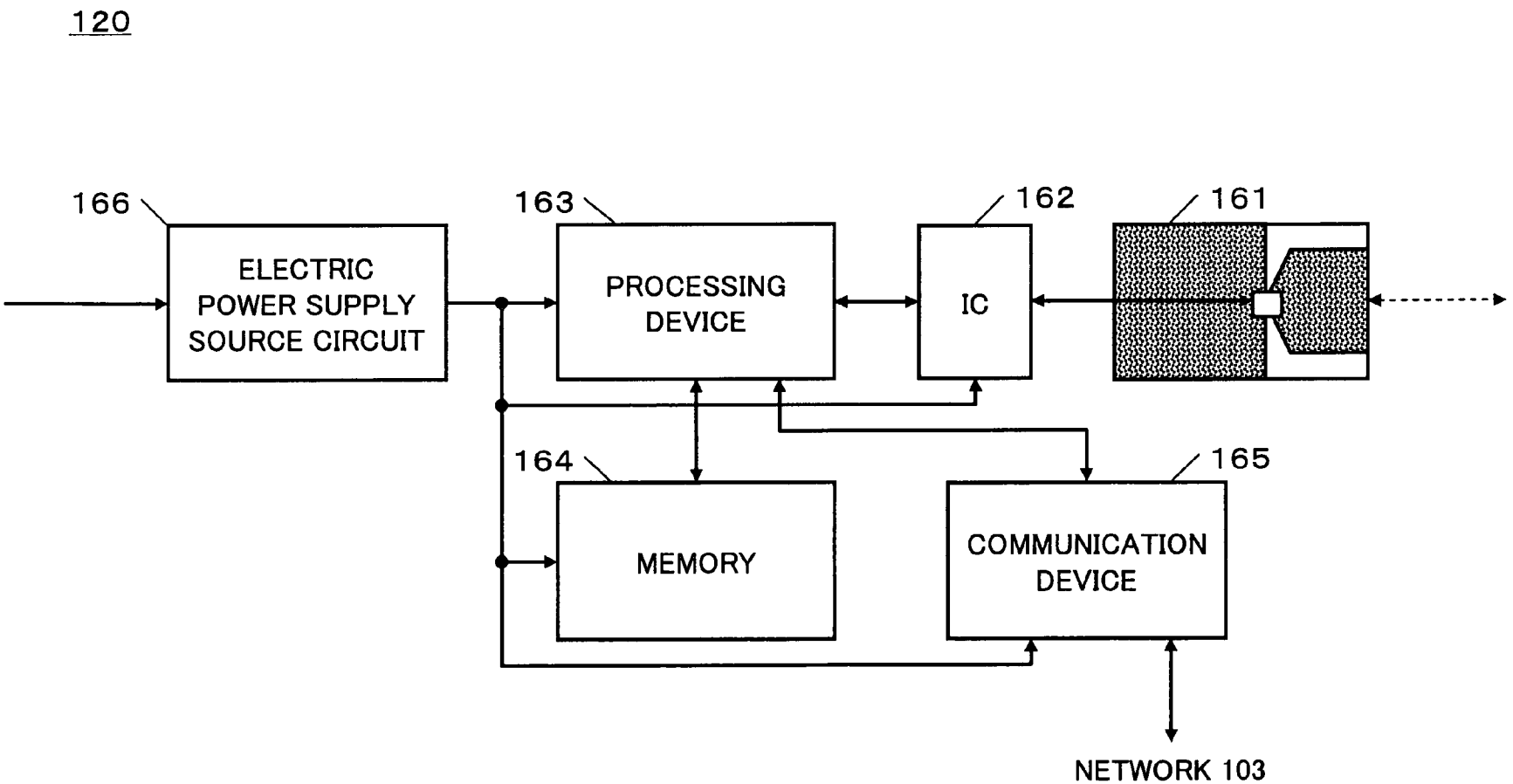
FIG. 5 is a block diagram of a point-to-point communication device 120.

FIG. 5 is a block diagram of the point-to-point communication device 120.

The point-to-point communication device 120 is fixed to the vicinity of the entrance of the entry prohibited area. The point-to-point communication device 120 includes an UWB antenna device 161, a UWB communication IC chip 162, a processing device 163, a memory 164, a communication circuit 165, an electric power supply circuit 166, and others.

The UWB antenna device 161 has the same structure as that of the UWB antenna device 131 shown in FIG. 4. The UWB antenna device 161 implements transmission and receipt of the UWB radio communications. The UWB antenna device 161 has directivity in a specific direction. The UWB antenna device 161 is arranged so as to have directivity in a direction where the shopper enters.

The UWB communication IC chip 162 implements the same process as that of the UWB communication ship 132. The UWB communication IC chip 162 forms an impulse waveform based on a signal from the processing device 163 and executes a process for restoring an original signal from the impulse wave form received by the UWB antenna device 161.

The processing device 163 executes various processes based on a point-to-point communication device control program installed in the memory 164 in advance.

The memory 164 includes a RAM, a ROM, and others. The terminal device control program executed by the processing device 163 is installed in the memory 164. The memory is used as an operations storage area for a process by the processing device 163.

The communication circuit 165 implements communication control with the network 103 so as to communicate with the entry detecting device 130.

An electric power supply circuit 166 is connected to an AC power supply and switches the AC power supply to a DC power supply. The electric power supply circuit 166 forms a driving electric power supply for driving the UWB communication IC chip 162, the processing device 163, the memory 164, the communication circuit 165, and others.

Figure 6:
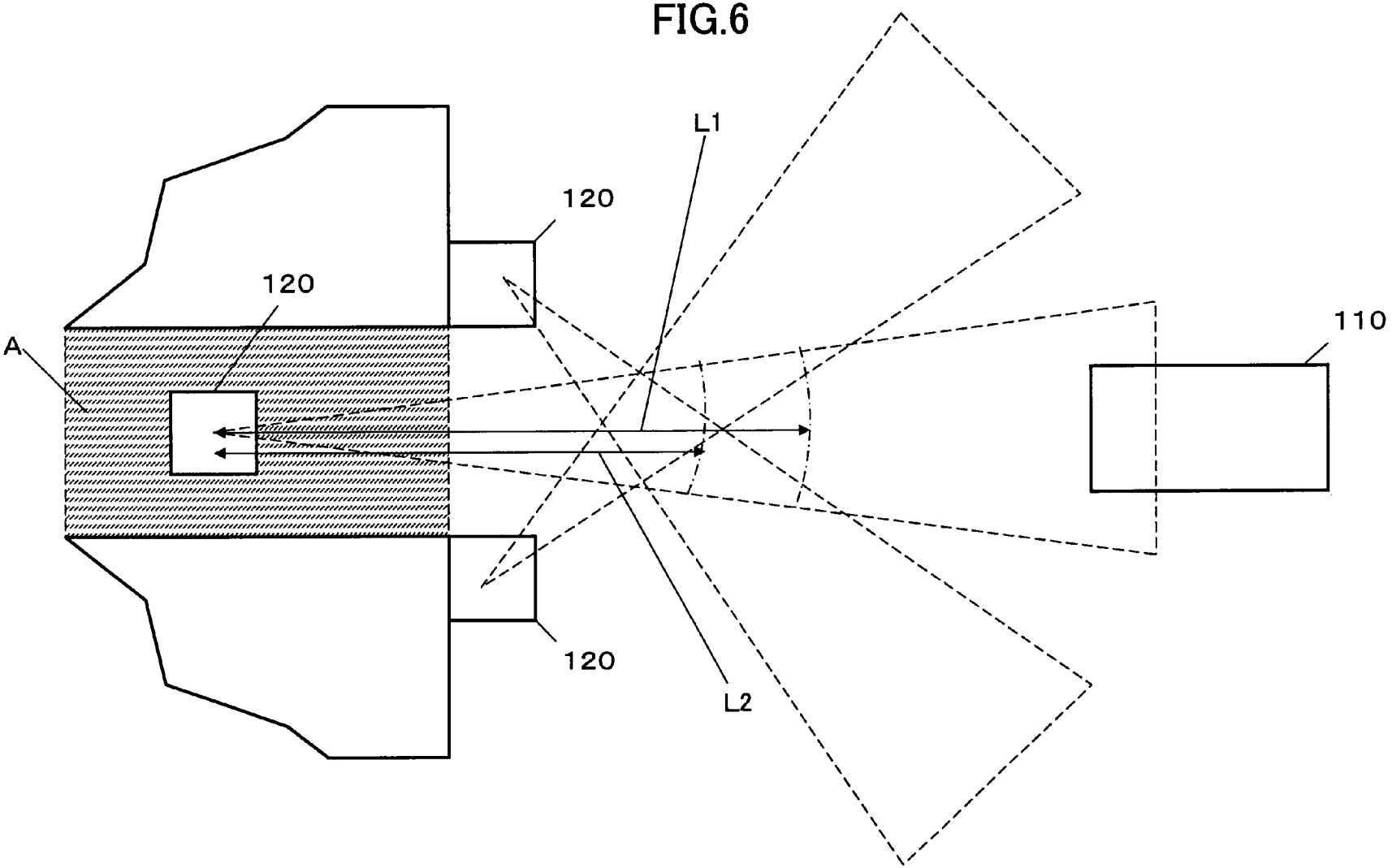
FIG. 6 is a view for explaining entry detecting operations of the terminal device 110 by the point-to-point communication device 120.

FIG. 6 is a view for explaining entry detecting operation of the terminal device 110 by the point-to-point communication device 120.

The point-to-point communication device 120 is arranged so that the UWB antenna device 161 has directivity in a direction where the shopper enters the entry prohibited area A. In this case where there are shopper entries in plural directions, as shown in FIG. 6, the plural point-to-point communication devices 120 are arranged in plural directions so that the UWB antenna device 161 has directivity.

As a result of this, it is possible to detect the entry in a specific direction. In addition, in the UWB communication, it is possible to measure the distance to the terminal device 110 with resolution of several tens cm by detecting the response time from the terminal device 110. Accordingly, it is possible to measure the distance to the terminal device 110.

The entry direction of the terminal device 110 and the distance to the entry prohibited area A can be detected by the plural point-to-point communication devices 120 so that movement of the terminal device 110 can be recognized. Therefore, it is possible to securely estimate the entry to the entry prohibited area A by the terminal device 110.

Next, a structure of the entry detecting system 130 shown in FIG. 1 is discussed.

Figure 7:
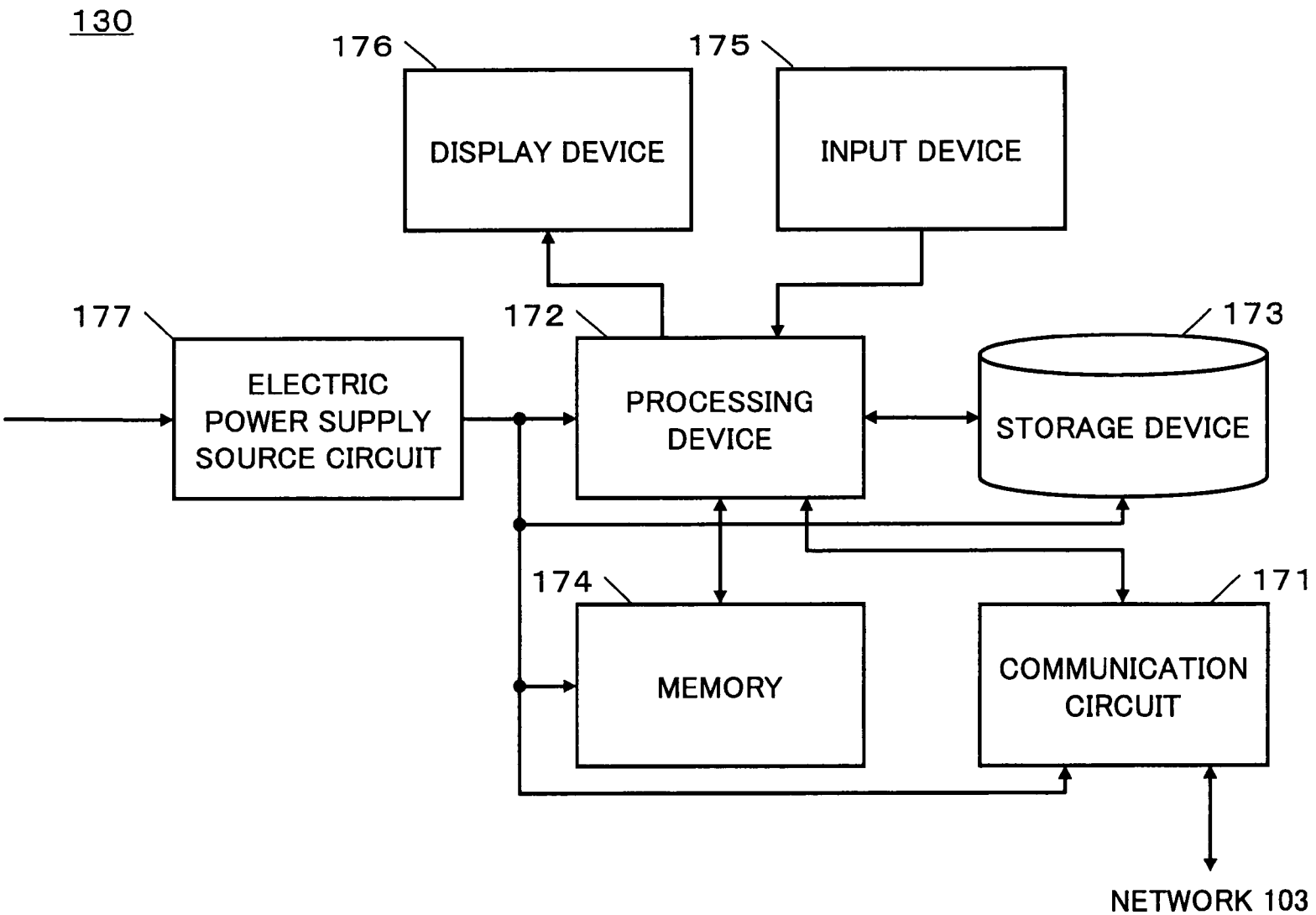
FIG. 7 is a block diagram of an entry detecting system 130.

FIG. 7 is a block diagram of the entry detecting system 130.

The entry detecting system 130 is formed by a computer system. More specifically, the entry detecting system 130 includes a communication circuit 171, a processing device 172, a storage device 173, a memory 174, an input device 175, a display device 176, an electric power supply circuit 177, and others.

The communication circuit 171 implements communication control with the network 103 and communicates with the plural point-to-point communication devices 120 and the guard device 140.

The processing device 172 executes various processes based on an entry detecting program installed in the storage device 173 in advance.

The storage device 173 is a hard disk device. The entry detecting program is installed in the storage device 173. The storage device 173 stores position information of the terminal device 110 calculated based on the response time of the terminal device 110 reported from the point-to-point communication device 120 based on the entry detecting program.

The memory 174 includes a RAM, a ROM, and others. The memory is used as an operations storage area of the processing device 172.

The input device 175 includes a key board, a mouse, and others. The input device 175 is used for issuing a command, inputting data, and others.

The display device 176 includes a CRT, LCD, and others. The display device 176 displays a graphic screen with information supplied from the processing device 172.

The electric power supply circuit 177 is connected to an AC power supply and switches the AC power supply to a DC power supply. The electric power supply circuit 177 forms a driving electric power supply for driving the communication circuit 171, the processing device 172, the storage device 173, the memory 174, and others.

Figure 8:
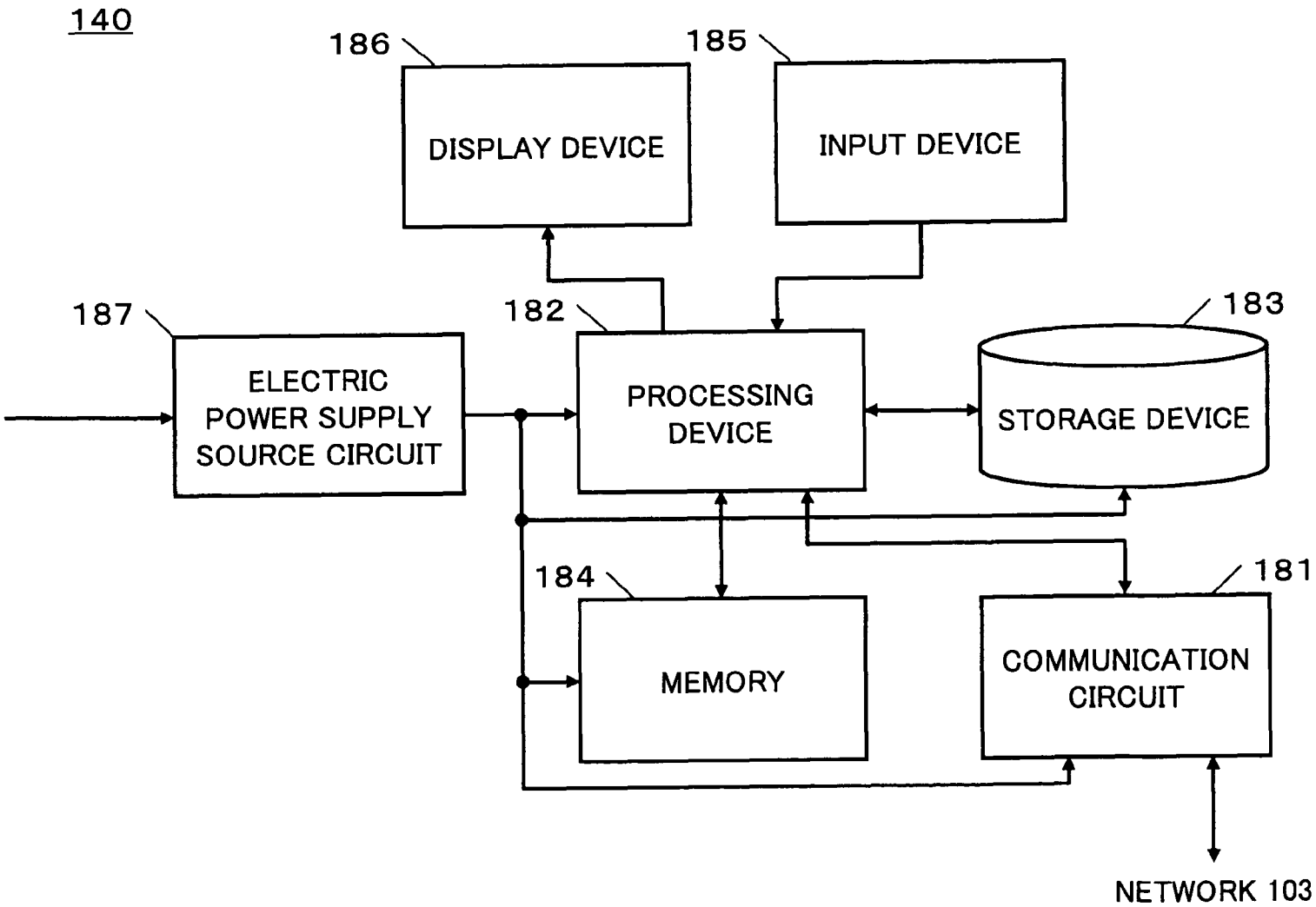
FIG. 8 is a block diagram of a guard device 140.

FIG. 8 is a block diagram of the guard device 140 shown in FIG. 1.

The entry detecting system 140 is formed by a computer system. More specifically, the entry detecting system 140 includes a communication circuit 181, a processing device 182, a storage device 183, a memory 184, an input device 185, a display device 186, an electric power supply circuit 187, and others.

The communication circuit 181 implements communication control with the network 103 and communicates with the plural point-to-point communication devices 120 and the entry detecting device 130.

The processing device 182 executes various processes based on a guard program installed in the storage device 183 in advance.

The storage device 183 is a hard disk device. The guard program is installed in the storage device 183.

The memory 184 includes a RAM, a ROM, and others. The memory is used as an operations storage area of the processing device 182.

The input device 185 includes a key board, a mouse, and others. The input device 185 is used for issuing a command, inputting data, and others.

The display device 186 includes a CRT, LCD, and others. The display device 186 displays a graphic screen with information supplied from the processing device 172.

The electric power supply circuit 187 is connected to an AC power supply and switches the AC power supply to a DC power supply. The electric power supply circuit 187 forms a driving electric power supply for driving the communication circuit 181, the processing device 182, the storage device 183, the memory 184, and others.

Next, the operations of the entry detecting system 100 are discussed.

Figure 9:
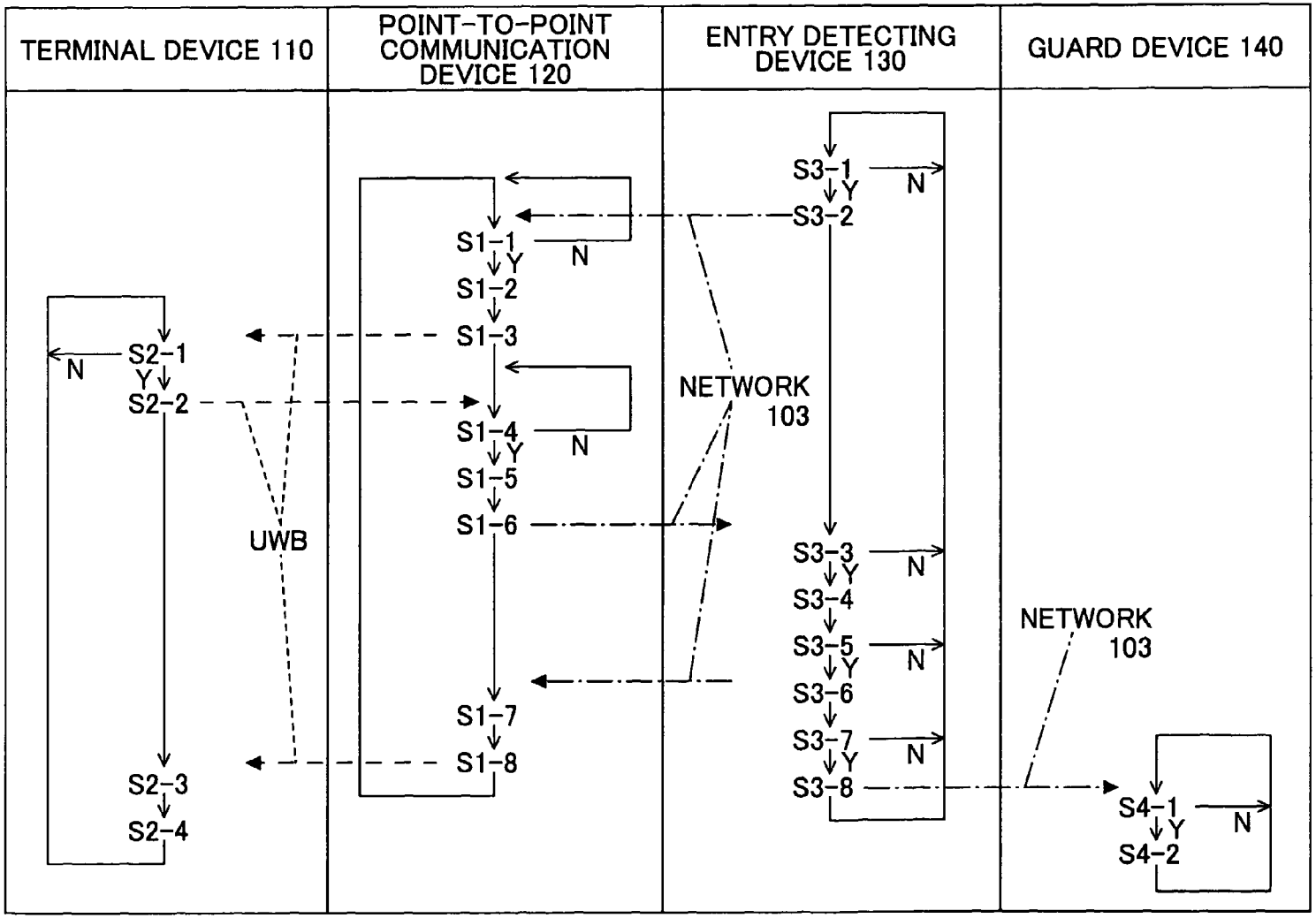
FIG. 9 is a process flowchart of an entry detecting system 100.

FIG. 9 is a process flowchart of the entry detecting system 100.

When a certain time passes (Y in step S3-1), the entry detecting device 130 transmits a response time information request to the point-to-point communication device 120 via the network 103 for every certain time in step S3-2 so as to wait for receiving the response time information from the point-to-point communication device 120 in step S3-3.

On the other hand, when the point-to-point communication device 120 receives the response time information request from the entry detecting device 130 in step S1-1 (Y in step S1-1), the point-to-point communication device 120 starts a built-in timer in step S1-2 and transmits the response request by the UWB by operating the UWB antenna device 161 and the UWB communication IC chip 162 in step S1-3.

The point-to-point communication device 120 also waits for response from the terminal device 110 in step S1-4. The response request requests a response.

When the terminal device 110 receives the response request from the point-to-point communication device 120 in step S2-1 (Y in step S2-1), the terminal device 110 transmits the response from the UWB antenna device 131 by operating the UWB communication IC chip 162 in step S2-2.

At this time, the terminal device 110 gives an ID for identifying the terminal device 110 to the response to be sent. The ID is stored in the memory 136 in advance.

When the point-to-point communication device 120 receives the response from the terminal device 110 in step S1-4 (Y in step S1-4), the point-to-point communication device 120 detects the response time with reference to a clock time of the built-in time in step S1-5.

The point-to-point communication device 120 transmits the response time information that the identification information of the terminal device 110 responding at the response time detected in step S1-6 is given, to the entry detecting device 130, via the network 103.

When the entry detecting device 130 receives the response time information from the point-to-point communication device 120 in step S3-3 (Y in step S3-3), the entry detecting device 130 detects the distance between the point-to-point communication device 120 and the terminal device 110 from the response time information in step S3-4.

The distance between the point-to-point communication device 120 and the terminal device 110 can be measured with high precision by using the UWB so that the position of the terminal device 110 can be detected with high precision.

In addition, since the antenna device 161 of the point-to-point communication device 120 has directivity in a specific direction, the entry detecting device 130 can specify the entry direction of the terminal device 110.

When the distance to the terminal device 110 detected in step S3-5 is equal to or less than the first entry distance L1 (Y in step S3-5), the entry detecting device 130 transmits the entry detecting information to the point-to-point communication device 120 in step S3-6.

When the point-to-point communication device 120 receives the entry detecting information in step S1-7, the point-to-point communication device 120 transmits the received entry detecting information to the terminal device 110 in step S1-8.

When the terminal device 110 receives the entry detecting information from the point-to-point communication device 120 in step S2-3 (Y in step S2-3), the terminal device 110 displays the entry prohibited mark on the display device 134 in step S2-4 so as to notify the shopper that the shopper is going into the entry prohibited area.

Figure 10:
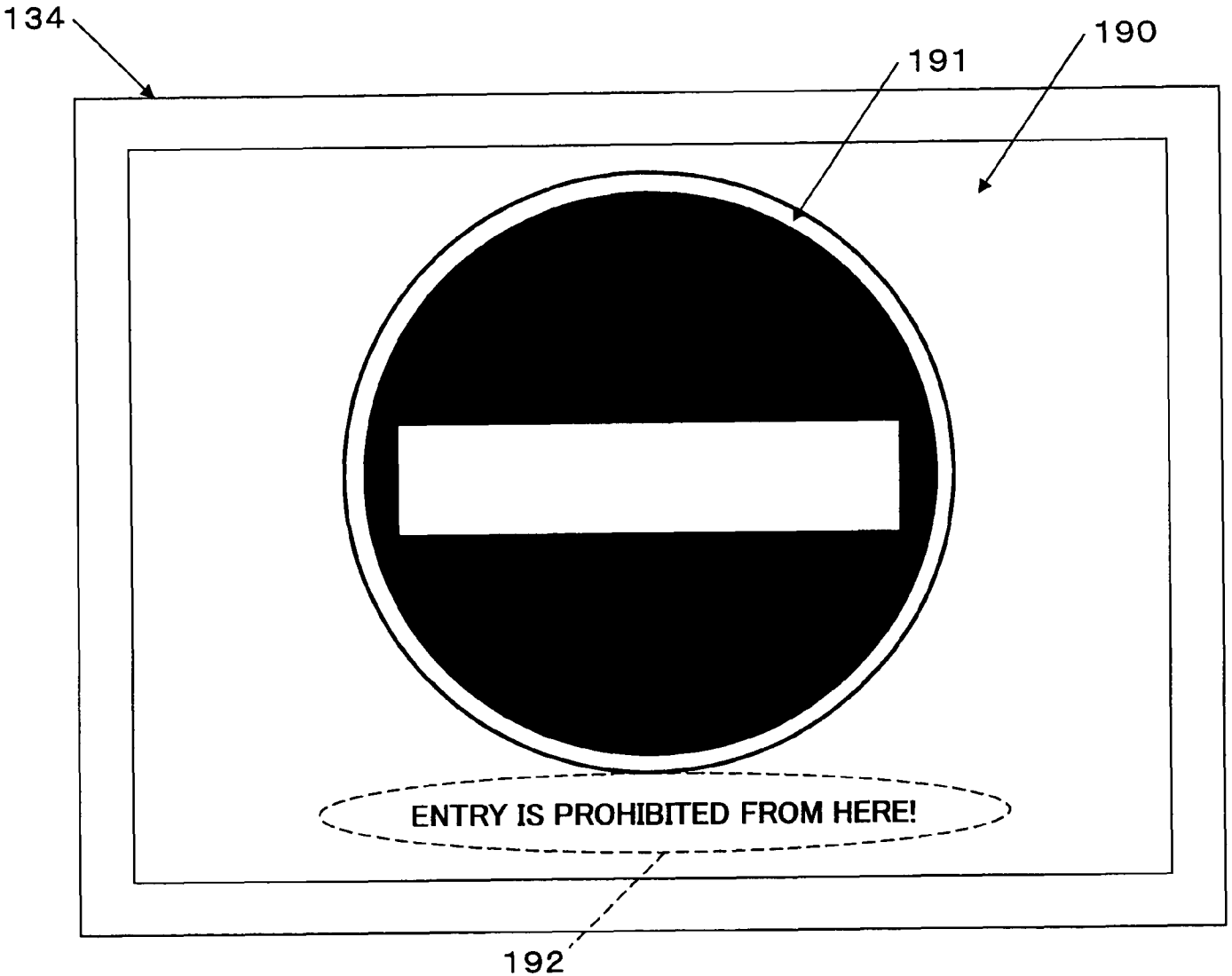
FIG. 10 is a schematic view showing an example of the display screen of the terminal device 110 in a case of entry prohibition.

FIG. 10 is a schematic view showing an example of the display screen of the terminal device 110 in a case of entry prohibition.

In a case of the entry prohibition, the terminal device 110, as shown in FIG. 10, displays an entry prohibition mark 191 and a notice 193 of "ENTRY IS PROHIBITED FROM HERE!" by characters on the screen 190 of the display device 134.

A speech output device is provided at the terminal device 110 so that a guide by sound (speech) or the like may be provided concurrently.

When the distance to the terminal device 110 detected in step S3-7 is equal to or less than a second entry distance L2 that is shorter than L1 (Y in step S3-7), the entry detecting device 130 transmits the entry detecting information to the guard device 140 in step S3-8.

When the guard device 140 receives the entry detecting information from the entry detecting device 130 in step S4-1 (Y in step S4-1), the guard device 140 displays on the display device 186 in step S4-2 that the shopper is going into the entry prohibited area.

The guard device 140 concurrently displays the position information of the point-to-point communication device 120 transmitting the entry detecting information. In this case, a guide by sound (speech) or the like may be provided concurrently.

A guard seeing the display of the display device 186 moves so as to advise the shopper that the shopper is about to enter the entry prohibited area.

In addition, a monitoring camera may be provided in the entry prohibited area so that a picture of the entry prohibited area of which the entry detecting information is transmitted is displayed.

As discussed above, in the first embodiment of the present invention, the entry detecting information is transmitted from the entry detecting device 130 to the terminal device 110 via the point-to-point communication device 120. However, the present invention is not limited to this. The entry detecting information may be transmitted from the guard device 140 to the terminal device 110 via the point-to-point communication device 120.

In addition, as discussed above, in the first embodiment of the present invention, the entry detecting is performed by the entry detecting device 130. However, the present invention is not limited to this. The entry detecting may be performed by the point-to-point communication devices 120 and the entry detecting information may be transmitted to the terminal device 110 and the guard device 140.

[Second Embodiment]

Figure 11:
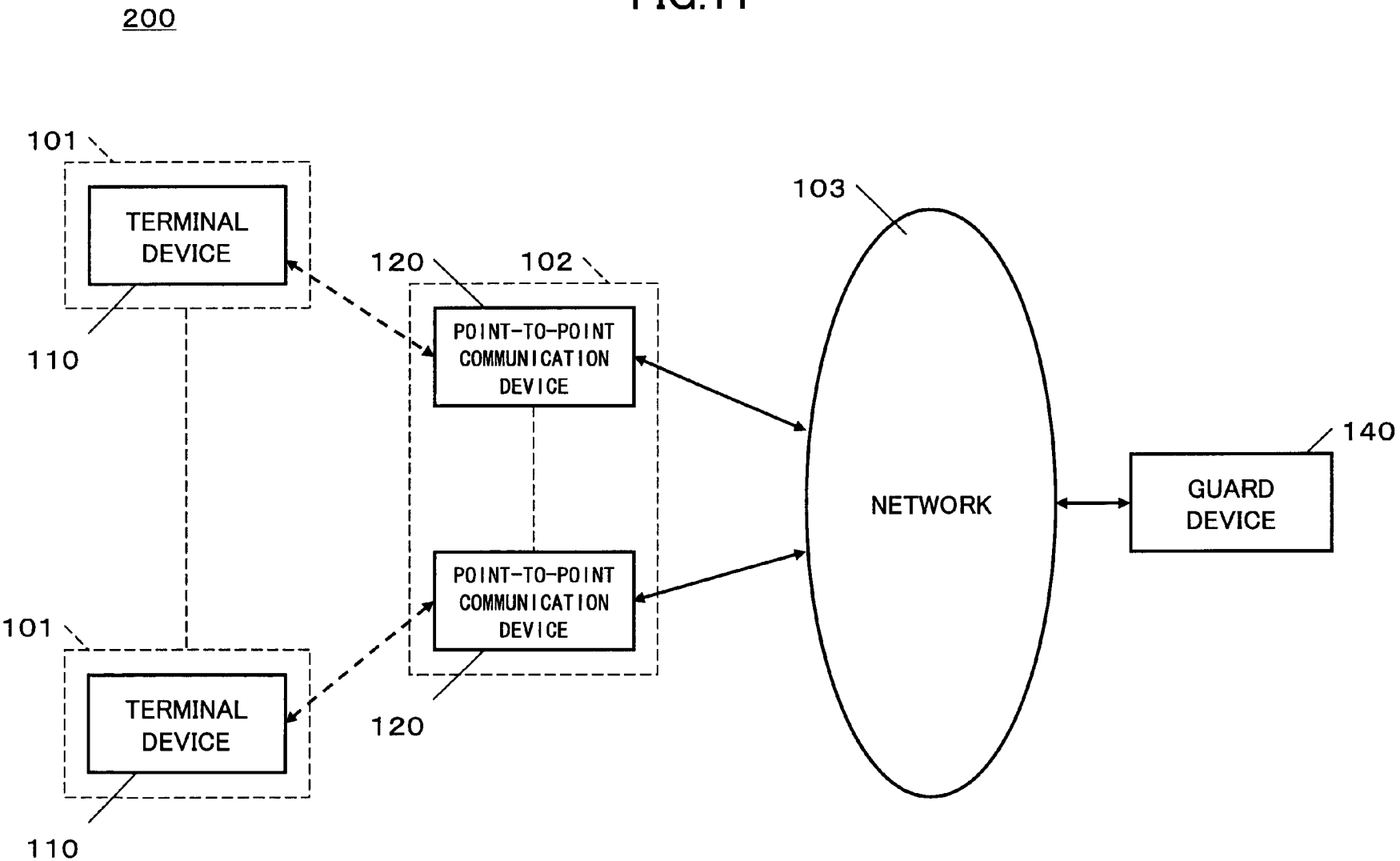
FIG. 11 is a schematic view of a system of a second embodiment of the present invention.

FIG. 11 is a schematic view of a system of a second embodiment of the present invention. In FIG. 11, parts that are the same as the parts shown in FIG. 1 are given the same reference numerals, and explanation thereof is omitted.

An entry detecting system 200 has a structure where functions of the entry detecting device 130 are provided in the point-to-point communication device 120.

Figure 12:
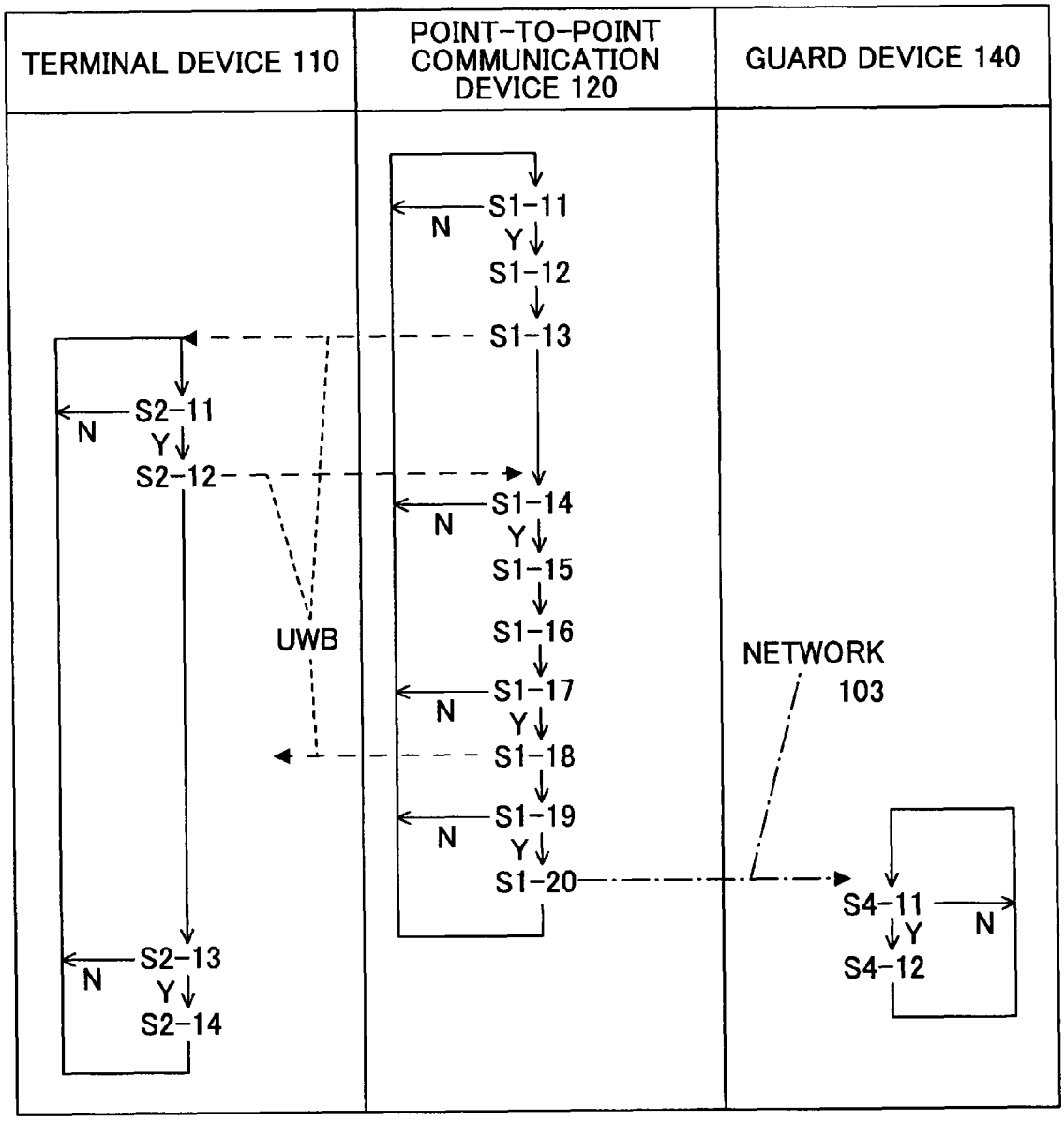
FIG. 12 is a process flowchart of an entry detecting system 200.

FIG. 12 is a process flowchart of the entry detecting system 200.

When a certain time passes in step S1-11 (Y in step S1-11), the point-to-point communication device 120 starts a built-in timer in step S1-12 and transmits the response request by the UWB by operating the UWB antenna device 161 and the UWB communication IC chip 162 in step S1-13.

The point-to-point communication device 120 also waits for a response from the terminal device 110 in step S1-14. The response request requests response.

When the terminal device 110 receives the response request from the point-to-point communication device 120 in step S2-11 (Y in step S2-11), the terminal device 110 transmits the response from the UWB antenna device 131 by operating the UWB communication IC chip 132 in step S2-12.

At this time, the terminal device 110 gives an ID for identifying the terminal device 110 to the response to be sent. The ID is stored in the memory 136 in advance.

When the point-to-point communication device 120 receives the response from the terminal device 110 in step S1-14 (Y in step S1-14), the point-to-point communication device 120 detects the response time with reference to a clock time of the built-in time in step S1-15.

The point-to-point communication device 120 detects the distance to the terminal device 110 based on the response time detected in step S1-16.

The distance between the point-to-point communication device 120 and the terminal device 110 can be measured with high precision by using the UWB so that the position of the terminal device 110 can be detected with high precision.

In addition, since the antenna device 161 of the point-to-point communication device 120 has directivity in a specific direction, the point-to-point communication device 120 can specify the entry direction of the terminal device 110.

When the distance to the terminal device 110 detected in step S1-17 is equal to or less than the first entry distance L1 (Y in step S1-17), the point-to-point communication device 120 transmits the entry detecting information to the terminal device 110 in step S1-18.

When the point-to-point communication device 120 receives the entry detecting information in step S1-6, the point-to-point communication device 120 transmits the received entry detecting information to the terminal device 110 in step S1-7.

When the terminal device 110 receives the entry detecting information from the point-to-point communication device 120 in step S2-13 (Y in step S2-13), the terminal device 110 displays the entry prohibited mark on the display device 134 in step S2-14 so as to notify the shopper that the shopper is going to enter the entry prohibited area. In this case, a guide by sound (speech) or the like may be provided concurrently.

When the distance to the terminal device 110 detected in step S1-19 is equal to or less than a second entry distance L2 that is shorter than L1 (Y in step S1-19), the point-to-point communication device 120 transmits the entry detecting information to the guard device 140 in step S1-20.

When the guard device 140 receives the entry detecting information from the point-to-point communication device 120 in step S4-11 (Y in step S4-11), the guard device 140 displays on the display device 186 in step S4-12 that the shopper is going to enter the entry prohibited area. The guard device 140 concurrently displays the position information of the point-to-point communication device 120 transmitting the entry detecting information.

According to the second embodiment of the present invention, the entry direction of the terminal device 110 and the distance to the entry prohibited area can be detected by the point-to-point communication devices 120.

Therefore, in the second embodiment, unlike the first embodiment, of the present invention, the entry detecting device 130 is not necessary so that the structure of the system can be simplified. Hence, application of the system can be easily done.

According to the above-discussed embodiments of the present invention, it is possible to provide an entry detecting system, including: a terminal device; a point-to-point communication device; an entry detecting device; and a guard device; wherein the point-to-point communication device includes a transmitting-receiving antenna having directivity in a specific direction; the point-to-point communication device communicates by radio with the terminal device via the transmitting-receiving antenna so as to detect a response time from the terminal device and report detected response time to the entry detecting device; the entry detecting device detects a distance from the point-to-point communication device to the terminal device based on the response time reported by the point-to-point communication device, generates entry detecting information based on the detected distance, and transmits the entry detecting information to the point-to-point communication device and the guard device; the point-to-point communication device transmits the received entry detecting information to the terminal device; the terminal device outputs an alarm in a case where the terminal device receives the entry detecting information from the point-to-point communication device; and the guard device outputs an alarm in a case where the guard device receives the entry detecting information from the entry detecting device.

The entry detecting device may transmit the entry detecting information to the terminal device via the point-to-point communication device in a case where the distance from the point-to-point communication device to the terminal device is a first distance; and the entry detecting device may transmit the entry detecting information to the guard device in a case where the distance from the point-to-point communication device to the terminal device is a second distance shorter than the first distance.

The transmitting-receiving antenna may perform UWB (Ultra-Wide-Band) communication.

According to the above-discussed embodiments of the present invention, it is also possible to provide an entry detecting system, including: a terminal device; a point-to-point communication device; and a guard device; wherein the point-to-point communication device includes a transmitting-receiving antenna having directivity in a specific direction; the point-to-point communication device communicates by radio with the terminal device so as to detect a response time from the terminal device and measure distance to the terminal device based on the detected response time; the point-to-point communication device reports the entry detecting information corresponding to the measured distance to the terminal device and the guard device; and the terminal device and the guard device output alarms when receiving the entry detecting information from the point-to-point communication device.

The point-to-point communication device may transmit the entry detecting information to the terminal device in a case where the measured distance is a first distance; and the point-to-point communication device may transmit the entry detecting information to the guard device in a case where the measured distance is a second distance shorter than the first distance.

The transmitting-receiving antenna may perform UWB (Ultra-Wide-Band) communication.

According to the above-discussed entry detecting system, the transmitting-receiving antenna having directivity in a specific direction is provided in the point-to-point communication device. The point-to-point communication device communicates by radio with the terminal device via the transmitting-receiving antenna so as to detect response time from the terminal device and report the detected response time to the entry detecting device.

In addition, the entry detecting device detects distance from the point-to-point communication device to the terminal device based on response time reported by the point-to-point communication device, so that the distance and direction of the terminal device are detected.

As a result of this, the terminal device and the guard device output an alarm. Therefore, entry to the entry prohibited area can be anticipated and it is possible to notify the shopper or the guard prior to the entry to the entry prohibited area that the entry to the entry prohibited area is about to be made.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This patent application is based on Japanese Priority Patent Application No. 2007-55819 filed on Mar. 6, 2007, the entire contents of which are hereby incorporated by reference.

What is claimed is:

1. An entry detecting system, comprising:

a terminal device;

a point-to-point communication device;

an entry detecting device; and a guard device;

wherein the point-to-point communication device includes a transmitting-receiving antenna having directivity in a specific direction and is configured to specify an entry direction of the terminal device;

the point-to-point communication device communicates by radio with the terminal device via the transmitting-receiving antenna so as to detect a response time from the terminal device and report detected response time to the entry detecting device;

the entry detecting device detects a distance from the point-to-point communication device to the terminal device based on the response time reported by the point-to-point communication device, generates entry detecting information based on the detected distance, and transmits the entry detecting information to the point-to-point communication device and the guard device;

the point-to-point communication device transmits the received entry detecting information to the terminal device;

the terminal device outputs an alarm in a case where the terminal device receives the entry detecting information from the point-to-point communication device; and the guard device outputs an alarm in a case where the guard device receives the entry detecting information from the entry detecting device, and wherein the entry detecting device transmits the entry detecting information to the terminal device via the point-to-point communication device in a case where the distance from the point-to-point communication device to the terminal device is a first distance; and the entry detecting device transmits the entry detecting information to the guard device in a case where the distance from the point-to-point communication device to the terminal device is a second distance shorter than the first distance.

2. The entry detecting system as claimed in claim 1, wherein the transmitting-receiving antenna performs UWB (Ultra-Wide-Band) communication.

3. An entry detecting system, comprising:

a terminal device;

a point-to-point communication device; and a guard device;

wherein the point-to-point communication device includes a transmitting-receiving antenna having directivity in a specific direction and is configured to specify an entry direction of the terminal device;

the point-to-point communication device communicates by radio with the terminal device so as to detect a response time from the terminal device and measure distance to the terminal device based on the detected response time;

the point-to-point communication device reports the entry detecting information corresponding to the measured distance to the terminal device and the guard device; and the terminal device and the guard device output alarms when receiving the entry detecting information from the point-to-point communication device, and wherein the point-to-point communication device transmits the entry detecting information to the terminal device in a case where the measured distance is a first distance; and the point-to-point communication device transmits the entry detecting information to the guard device in a case where the measured distance is a second distance shorter than the first distance.

4. The entry detecting system as claimed in claim 3, wherein the transmitting-receiving antenna performs UWB (Ultra-Wide-Band) communication.

* * * * *